US008794482B2

(12) United States Patent
Sack et al.

(10) Patent No.: US 8,794,482 B2
(45) Date of Patent: Aug. 5, 2014

(54) PILL DISPENSER

(75) Inventors: Ryen Sack, Hampshire, IL (US); Curtis A Knutson, Loves Park, IL (US); Thomas Moyer, Freeport, IL (US)

(73) Assignee: AndersonBrecon Inc., Rockford, IL (US)

( * ) Notice: Subject to any disclaimer, the term of this patent is extended or adjusted under 35 U.S.C. 154(b) by 180 days.

(21) Appl. No.: 13/246,083

(22) Filed: Sep. 27, 2011

(65) Prior Publication Data

US 2013/0075418 A1 Mar. 28, 2013

(51) Int. Cl.
*A61J 7/00* (2006.01)
*B65D 83/04* (2006.01)

(52) U.S. Cl.
CPC ..... *A61J 7/0076* (2013.01); *B65D 2215/06* (2013.01); *B65D 83/0445* (2013.01); *B65D 83/0454* (2013.01)
USPC ..... 221/80; 221/87; 221/74; 221/268

(58) Field of Classification Search
USPC ..... 221/27, 32, 74, 80, 87, 268
See application file for complete search history.

(56) References Cited

U.S. PATENT DOCUMENTS 3,807,551 A * 4/1974 Ankney ..... 206/539
3,984,031 A 10/1976 Thompson
4,038,937 A * 8/1977 Moe ..... 116/308
4,062,445 A * 12/1977 Moe ..... 206/1.5
4,069,942 A 1/1978 Marshall et al.
4,078,661 A 3/1978 Thomas
4,124,143 A 11/1978 Thomas
4,164,301 A 8/1979 Thayer
4,372,445 A * 2/1983 Keffeler ..... 206/532
4,555,044 A 11/1985 Pearo
4,693,371 A * 9/1987 Malpass ..... 206/538
4,741,441 A * 5/1988 Keffeler ..... 206/532
4,872,559 A * 10/1989 Schoon ..... 206/538
4,887,790 A * 12/1989 Wilkinson et al. ..... 249/52
5,379,899 A * 1/1995 Thurell ..... 206/538
5,381,904 A * 1/1995 Thurell ..... 206/538
6,325,241 B1 12/2001 Garde et al.
6,726,058 B2 * 4/2004 Giraud ..... 221/267
7,100,793 B2 9/2006 Baum
7,147,127 B2 12/2006 Lepke et al.
7,243,797 B2 7/2007 Donegan
7,353,969 B2 4/2008 McHutchinson
7,581,642 B2 9/2009 Knutson et al.
7,617,935 B2 11/2009 Reilley et al.
7,806,270 B2 10/2010 Seibert et al.
7,896,161 B2 3/2011 Reilley et al.
7,900,772 B2 3/2011 Sack et al.

(Continued)

FOREIGN PATENT DOCUMENTS

FR 2956027 A1 8/2011

OTHER PUBLICATIONS

International Search Report and Written Opinion dated Jan. 17, 2013 for International Application No. PCT/US2012/057442.

*Primary Examiner* — Patrick Mackey
(74) *Attorney, Agent, or Firm* — Howson & Howson LLP

(57) ABSTRACT

Dispensers for packaging solid unit dosage forms, e.g., tablets, are described herein, the dispensers employing a deformable elastomeric wiper seal between a cover and a base. The cover is linearly or rotatably slidable relative to the base to seal and/or expose the compartments of the base.

18 Claims, 7 Drawing Sheets

(56) References Cited

U.S. PATENT DOCUMENTS

| | | | | |
|---|---|---|---|---|
| 7,967,144 | B2 | 6/2011 | Sack et al. | |
| D642,467 | S | 8/2011 | Knutson et al. | |
| 8,205,752 | B2 | 6/2012 | Sack et al. | |
| 2004/0169049 | A1* | 9/2004 | Giraud | 221/263 |
| 2009/0200330 | A1 | 8/2009 | Giraud | |
| 2011/0068039 | A1 | 3/2011 | Sack et al. | |
| 2011/0186469 | A1 | 8/2011 | Sack et al. | |
| 2011/0215022 | A1 | 9/2011 | Sack et al. | |

* cited by examiner 48
50
44
38a
40
38a
42
48
38
44
50
24
40
42
28a
28
22
46
32
32
26
36
36a
28
36
36a
34
30
30
D1

FIG. 3
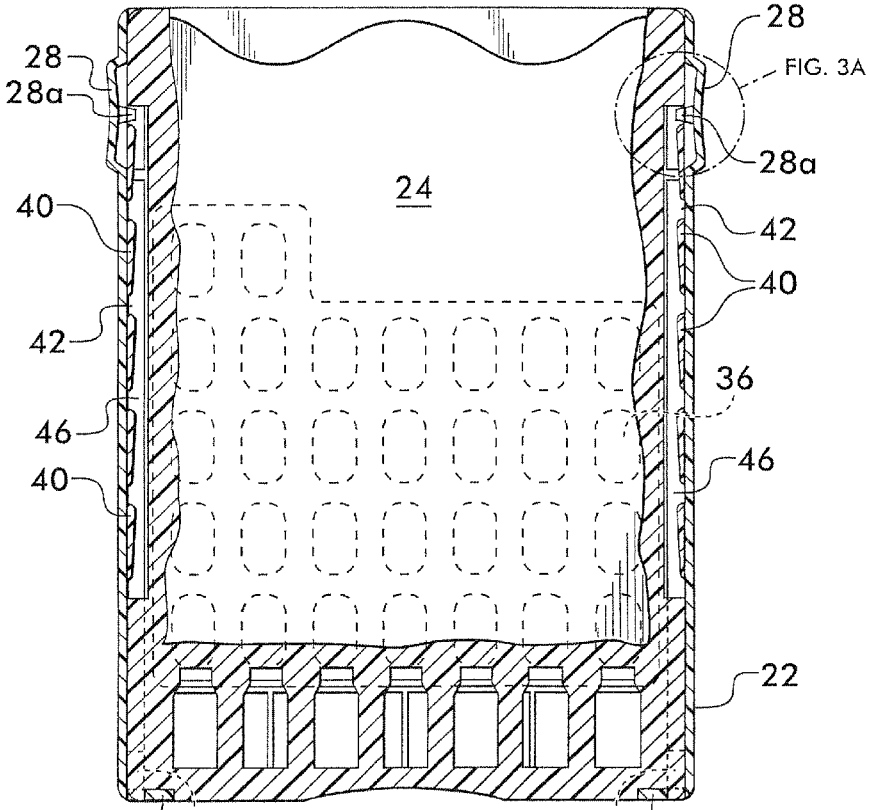
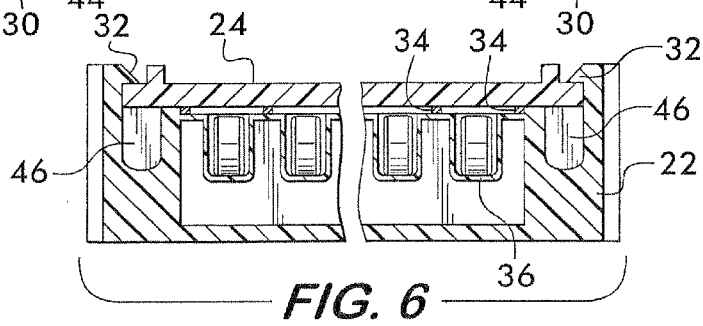
FIG. 6

PILL DISPENSER

BACKGROUND OF THE INVENTION

A compact container or package for containing and storing items, such as tablets, doses of medicine, or the like, is disclosed, and more particularly, hand-held rectangular slide pill dispensers and rotary pill dispensers, each providing child-resistant, senior-friendly dispensing properties, are disclosed.

Individuals may rely on multi-compartment pill boxes in order to merge their daily prescriptions and vitamin/mineral supplements. These multi-compartment boxes enable the user to fill them on a periodic basis, e.g. weekly, and then when in use, the box marked with the days of the week and/or time of day assists the user in ensuring that the appropriate pills are taken.

Pill dispensers enable users to dispense a single pill or other solid unit dosage form periodically, e.g., daily. By way of example, U.S. Pat. No. 4,069,942 issued to Marshall et al. discloses a substantially disc-shaped refillable dispenser and U.S. Pat. No. 4,555,044 issued to Pearo discloses a disc-shaped pill dispenser having a rotating cover with a dispensing aperture. Examples of other disc-shaped dispensers are provided by U.S. Pat. No. 3,984,031 issued to Thompson, U.S. Pat. Nos. 4,078,661 and 4,124,143 issued to Thomas, U.S. Pat. No. 4,164,301 issued to Thayer, U.S. Pat. No. 6,325,241 B1 issued to Garde et al., U.S. Pat. No. 7,147,127 B2 issued to Lepke et al., and U.S. Pat. No. 7,243,797 B2 issued to Donegan.

Although the packages disclosed by the above referenced patents may be suitable for their intended purposes, there is a need for a dispenser that is of novel construction enabling efficient and inexpensive manufacture and assembly. The package should be useful in consumer packaging applications, for instance, packaging of pharmaceuticals or unit dose pharmaceuticals that may require repeated dispensing of doses of medicine over a period of time until the course of medication is complete. The packages should enable a user to easily track the consumption of doses according to a prescribed schedule and should provide a so-called child resistance (CR) rating of F=1 to ensure that the package has sufficient integrity to prevent unwanted access of the medicine by a young child in the event that a young child accidentally gains possession of the package. Although the package should have child-resistance dispensing properties, it should also enable ready dispensing by an intended end-user, such as a senior citizen.

SUMMARY OF THE INVENTION

The present application provides dispensers for packaging and dispensing solid unit dosage forms, e.g., tablets, comprising a deformable elastomeric seal on a top of a base or an underside of the cover for forming a tight seal between the cover and the compartments disposed in the base.

According to one embodiment, a slide dispenser for packaging and dispensing solid unit dosage forms, e.g., tablets, is provided and has a cover and a base. The base may form one side of the dispenser, have at least one row of spaced-apart hollow compartments for containing tablets, and may be provided in a rectangular or other shape. The compartments of the base have openings that are capable of being covered by a cover linearly slidable relative to the base. A deformable elastomeric seal is located on the surface of the base between the openings of the compartments and is placed into a compressed state when engaged by the cover for purposes of tightly sealing the compartments. One end of the cover may have a linear array of flip-up dispensing caps corresponding to the spaced-apart hollow compartments of the base. When connected to the base, the cover may be permitted to slide relative to the base, and when the cover is slid relative to the base, the row of flip-up dispensing caps can be aligned with one row of the spaced-apart hollow compartments in the base for purposes of dispensing the contents of one or more compartments of the row.

A method of manufacturing a child-resistant dispenser for packaging and dispensing pills is also provided. The method includes a step of injection molding a cover from plastic material. The cover may include a row of flip-up dispensing caps. The method also includes a step of injection molding a base having at least one row of spaced-apart hollow compartments from a plastic material and an elastomeric material via a dual shot injection molding operation such that a deformable elastomeric seal is molded integrally on the surface of the base between the openings of the compartments. Pills or other solid unit dosage forms are then loaded into the compartments of the base. After the loading step, the cover is connected to the base to form a dispenser in which the cover extends over the openings of the compartments such that the elastomeric seal is in a compressed state thereby tightly sealing the compartments.

According to a second embodiment, a rotary dispenser for packaging and dispensing solid unit dosage forms, e.g., tablets, is provided. The rotary dispenser comprises a deformable elastomeric seal, for instance, formed on an underside of a cover. The cover with seal form a tight seal over a base and the compartments disposed therein.

Thus, the rotary dispenser may include a base forming one side of the dispenser and a cover forming an opposite side of the dispenser. The base may have at least one circular array of spaced-apart hollow compartments for containing tablets, and the cover may be connected to the base in a manner permitting the cover to rotate relative to the base. The compartments of the base have openings and the cover extends over the openings of the compartments. A deformable elastomeric seal is located on an underside of the cover and is rotatable with the cover relative to the base and extends over and confronts the openings of the compartments in a compressed state to tightly seal the compartments. A dispensing opening is formed through the deformable elastomeric seal and cover and is alignable with the openings of the compartments one-at-a-time to permit sequential dispensing from the compartments.

A method of manufacturing a child-resistant rotary pill dispenser for packaging and dispensing pills is also provided. The method includes a step of injection molding a base from plastic material such that the base has a circular array of hollow pill compartments molded in a face thereof. The method also includes a step of injection molding a cover from a plastic material and an elastomeric material via a dual shot injection molding operation such that a deformable elastomeric seal is molded integrally on an underside of the cover. Pills are loaded in the compartments of the base. After the loading step, the cover is connected to the base and extends over the compartments to form a rotary dispenser in which the elastomeric seal is in a compressed state to permit the cover to tightly seal the compartments.

Still other embodiments are described herein and reflected in the figures and will be apparent to one of ordinary skill in the art.

BRIEF DESCRIPTION OF THE DRAWINGS

The features of the embodiments should become apparent from the following description when taken in conjunction with the accompanying drawings, in which:

FIG. 3 is a plan view of the slide dispenser shown in FIG. 1 with a part of the cover shown cut-away for illustrative purposes only;

FIG. 6 is a cross-sectional view taken vertically through a first row of compartments of the slide dispenser of FIG. 1;

DETAILED DESCRIPTION OF THE INVENTION

The present application is directed to dispensers for packaging and dispensing solid unit dosage units, e.g., tablets or pills. As used herein, the terms "tablets", "pills", and other specific solid unit dosage forms are intended to encompass any solid unit dosage form. Other solid unit dosage forms, including those known in the art and not recited herein, are intended to be encompassed by the terms "solid unit dosage form", "tablet", and "pill". In addition, the disclosed dispenser bodies are not limited to storing and dispensing medicine and can also be used for packaging/dispensing vitamins, gum, candy and any other set of relatively small items.

Slide Dispenser

Figures 1, 3A, 5:
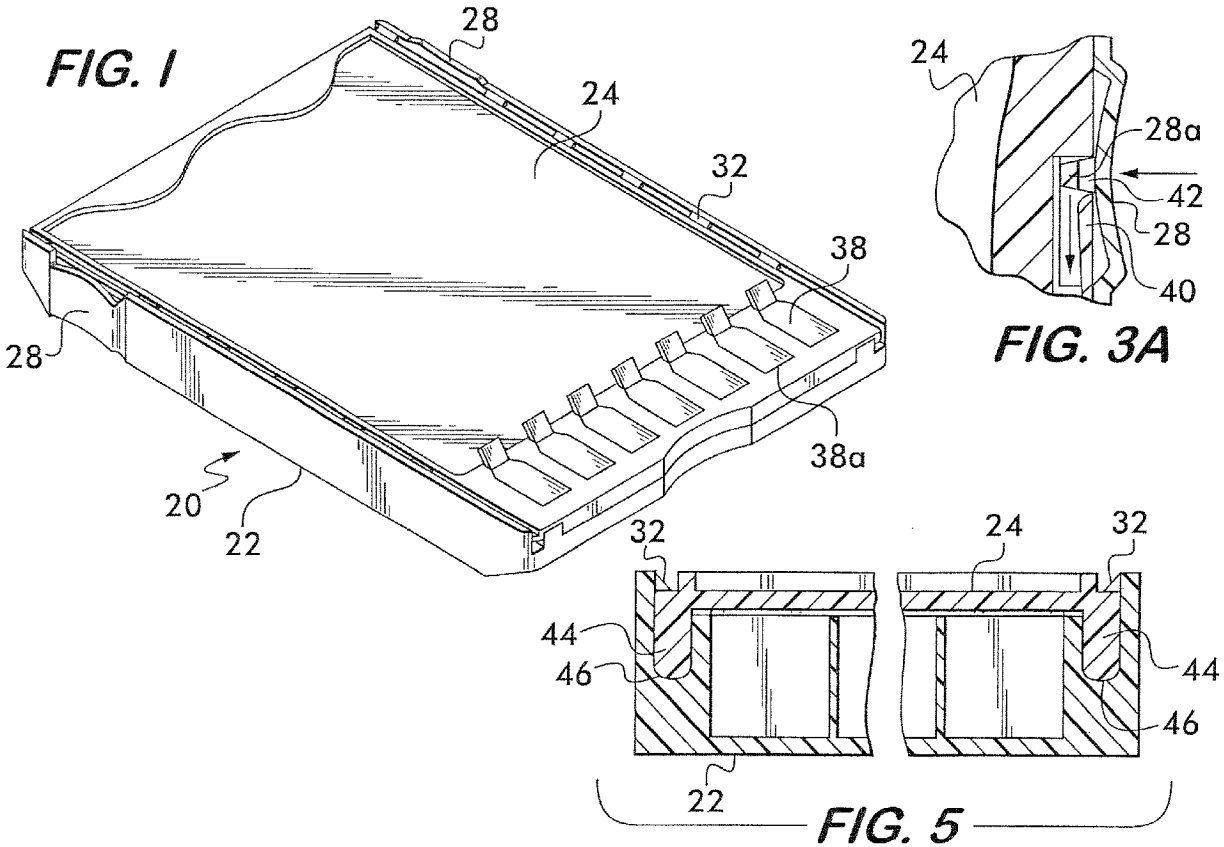
FIG. 1 is a perspective view of a slide dispenser in a closed, compact, storage condition according to one contemplated embodiment.
FIG. 3A is a magnified view of a part of the slide dispenser that is circled with dashed lines in FIG. 3.
FIG. 5 is a cross-sectional view taken vertically through the front edge of the slide dispenser of FIG. 1.

The body of a dispenser 20 having a base 22 and a cover 24 is shown in FIG. 1. This particular embodiment has a relatively rectangular shape and a cover 24 which slides across the face of the base 22. The body of the dispenser 20 can be produced and provided in other shapes, and different means of moving the cover 24 relative to the base 22 can be provided. In the embodiment illustrated in FIG. 1, the cover 24 is slidable relative to the base 22 to enable tablets stored in compartments 36 of the base to be dispensed. The dispenser 20 includes a locking mechanism and unlocking mechanism which prevents the cover 24 from sliding relative to the base 22 (and thus tablets from being dispensed) without certain manipulations being performed to the dispenser 20 by the user.

By way of example, the dispenser 20 can be produced of a size capable of being gripped by a single hand of an intended user, but not by a young child in a manner required to enable dispensing from the dispenser 20. For instance, when the dispenser 20 is supported on or adjacent an adult hand, the tips of the thumb and index or middle finger of the same hand should be able to engage about the opposed peripheral edges of the dispenser 20 and squeeze flexible tabs 28 formed in the base 22 of the dispenser 20. For instance, see FIG. 3A. The other hand of the user should remain free to enable it to slide the cover 24 of the dispenser 20 relative to the base 22 of the dispenser 20 while the tabs 28 are squeezed. For instance, see FIG. 4. In contrast, a single hand of a young child is likely to be too small to grip and simultaneously squeeze the tabs 28 of the base 22 and a young child is not expected to have the required dexterity needed to squeeze both tabs and simultaneously apply a force to slide the cover 24 relative to the base 22. Thus, the dispenser 20 provides child-resistance dispensing properties.

Figure 2:
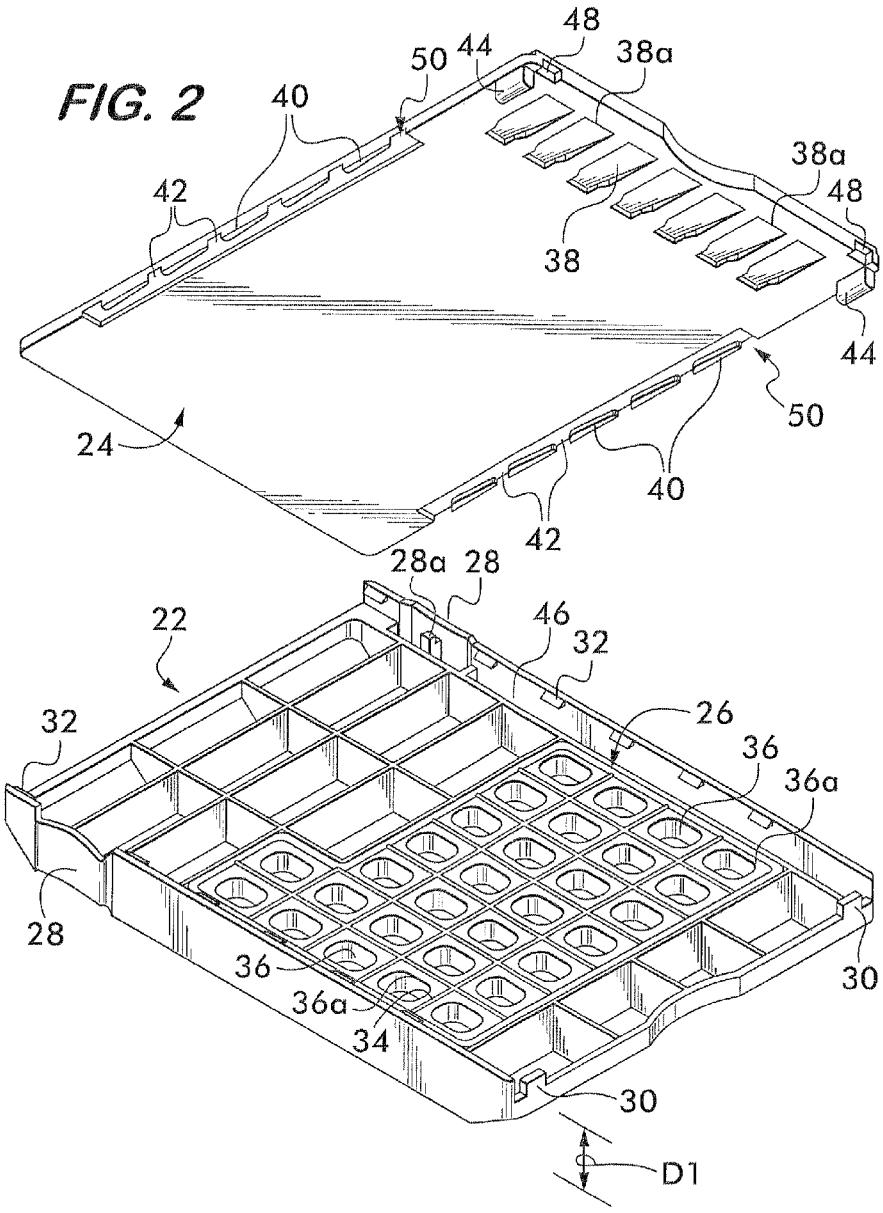
FIG. 2 is an exploded perspective view of the two-piece body of the dispenser of FIG. 1 in a pre-assembled condition.

The body of the dispenser 20 can be constructed and/or assembled solely from an opposed pair of separately manufactured body parts, i.e., the base 22 and the cover 24, for instance, as best shown in FIG. 2. Thus, assembly of the dispenser 20 may require only a single step, i.e., connecting body part, or base, 22 to body part, or cover, 24 such as by sliding body part 24 under flange segments 32 of the body part, or base, 22.

For ease of description only, the parts 22 and 24 can be referred to as a "base" and "cover", respectively; however, these terms are relative and interchangeable and either part can be viewed as a base or a cover or as a top or a bottom of the dispenser. For purposes of the present description, the body part 22 is termed the "base" and the body part 24 is termed the "cover" with no limitation being implied.

The base 22 is of a sufficient depth "D1" enabling it to define at least one row of separate, spaced-apart, hollow compartments 36, each capable of containing a tablet or like item to be stored and ultimately dispensed. As best shown in FIG. 2, the base 22 of the illustrated embodiment includes four rows of seven compartments 36 and one row of two compartments 36 providing a total of thirty compartments 36. This is merely provided by way of example and the base 22 can be modified to provide fewer or more compartments 36 in any array, size, shape, or pattern.

The base 22 includes an upper face 34 which is normally located and embedded within the assembly of the dispenser 20 underneath the cover 24. The face 34 is generally planar and is co-planar with and surrounds the open ends 36*a* of the compartments 36. Thus, each hollow compartment 36 can be recessed relative to or behind the face 34 of the base 22 and otherwise provides a sealed compartment except for the open ends 36*a*.

The upper face 34 of the base 22 includes a layer of a deformable elastomeric seal 26 which covers most surfaces of the face 34 immediately adjacent compartments 36 to surround each of the open ends 36*a*.In other contemplated embodiments, the compartments 36, or at least parts of the compartments 36, are also formed of the elastomeric material. The elastomeric material does not extend over or fully block the open ends 36*a* of compartments 36; rather, the elastomeric material merely surrounds each open end 36*a* and forms a rim of each compartment 36. The elastomeric seal 26 is affixed on face 34 of base 22 and is secured in a stationary position on or relative to the base 22 and is slidable with base 22 relative to the cover 24. When the cover 24 is connected to the base 22, the seal 26 directly confronts the underside of the cover 24 and is at least slightly or partially compressed thereby rendering the open ends 36*a* of compartments 36 sealed in an air-tight or fluid-tight manner. As an alternative, the layer of elastomeric material forming the seal 26 could be formed on the underside of the cover 24.

The compressed state of the elastomeric seal 26 permits it to provide a fluid- or air-tight seal for each compartment 36 with a portion of the cover 24 extending over the open end 36*a* of the compartment 36. Thus, although the compartments 36 may be slidable relative to the cover 24, the elastomeric seal 26 functions as a so-called "wiper seal" and maintains a seal despite the relative movement between the base 22 and seal 26 on one hand and the cover 24 on the other. This type of seal prevents moisture, humidity, contaminants and the like from entering a compartment 36 prior to its contents being dispensed. It also eliminates the need for the use of a separate blister cover, foil covering, blister card structure, or the like over or in compartments 36. Thus, no additional internal packaging element is required (only the base 22 and cover 24) thereby reducing manufacturing, materials, and assembly complexity and costs.

The cover 24 forms an opposite part of the dispenser 20 relative to the base 22 and connects to the base 22 in a manner permitting cover 24 to be slidably engaged with base 22 including seal 26. The cover 24 may be composed of transparent material permitting visualization of the tablets remaining in the base 22. Alternatively, the cover 24 could be opaque or could be applied with a sticker or the like having indicia providing information concerning the tablets. As the cover 24 is slid or advanced across the base 22, a part of the face 34 of the base and a row or rows of compartments 36 (preferably, a row or rows of compartments 36 that are empty from which tablets were previously dispensed) become exposed.

In the embodiment shown in FIG. 1, a portion of cover 24 has a row of flip-up dispensing caps 38 integrally-formed therein which correspond to the pattern of compartments 36 in each row of compartments 36 of the base 22. When open, the caps 38 permit tablets to pass from compartments 36 aligned thereto through the cover 24 so that the tablets can be dispensed from the dispenser 20. For this purpose, the caps 38 can be aligned and indexed over each row of the compartments 36 via sliding of the cover 24 a needed distance relative to the base 22. For instance, see FIG. 4 in which the cover 24 is slid relative to the base 22 such that the caps 38 are aligned and indexed over the first row of compartments 36 of the dispenser 20. The caps 38 may be formed with live hinges 38*a* integral with the cover 24 so as to permit easy opening of the compartments 36 (when the caps 38 are positioned thereover) and then easy closing of the compartments 36 prior to advancing cover 24 to its next position relative to base 22 or to a completely-closed, compact, storage position as shown in FIG. 1. In a further contemplated embodiment, the caps 38 may be interconnected thereby permitting all caps 38 to be opened simultaneously. Such an embodiment would more readily enable the user to transfer the contents of an entire row of compartments 36, if desired, to a separate pill box or the like in a quick and convenient manner. If desired, each row of compartments 36 can contain seven compartments 36 extending laterally across the width of the dispenser 20 (as best shown in FIG. 2) in order to accommodate one or more pills for each day of the week.

The base 22 may include a plurality of inwardly-extending flange segments 32 along the edges (i.e., at least one on each side) of base 22 slightly above the face 34 of the base. The flange segments 32 extend over the edges of the exposed face of the cover 24 to secure the cover 24 firmly to the base 22 and seal 26. The flange segments 32 extend parallel to the plane of movement of cover 24 along the length of the rectangular dispenser 20. In addition, the underside of the cover 24 may include a pair of guide ribs 44 that slide within guide grooves or tracks 46 formed adjacent the sides of the base 22 under the flange segments 32. See FIG. 5. In this manner, controlled and smooth sliding of the cover 24 relative to the base 22 can be ensured. In addition, the base 22 may include stops 30 arranged to engage stop slots 48 formed in the cover 24 to prevent the cover 24 from sliding off one of the ends of the base 22. Thus, the cover 24 can always be readily returned and slid to the compact, closed, storage position shown in FIG. 1 and, in this position, the cover 24 is preventing from sliding beyond the stops 30.

Figure 4:
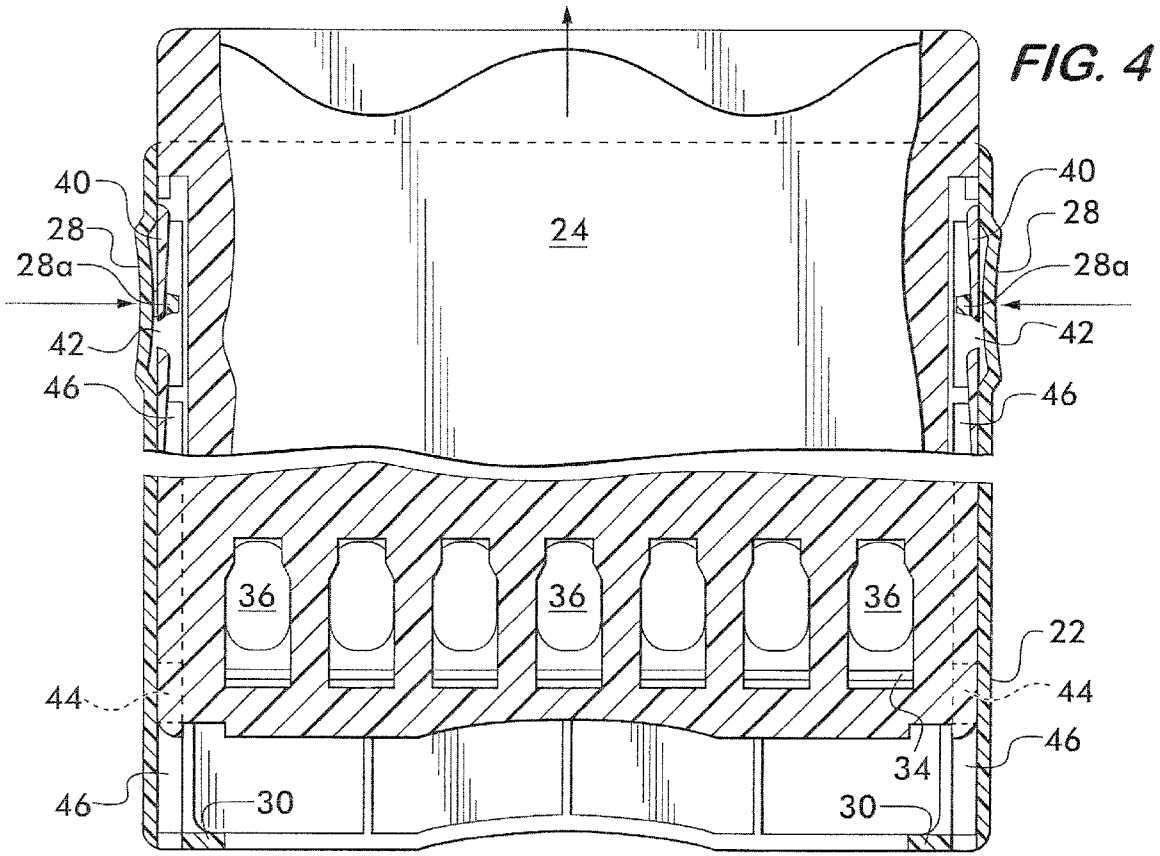
FIG. 4 is a plan view of the slide dispenser shown in FIG. 3 with the cover being slid relative to the base.

As best illustrated in FIGS. 3, 3A and 4, the slide dispenser 20 has a locking mechanism preventing sliding of the cover 24 relative to the base 22 in normal conditions and an unlocking mechanism that, when actuated, permits sliding of the cover 24 relative to base 22. The locking and unlocking mechanisms provide the dispenser with child-resistance. Preferably, the locking mechanism prevents sliding only in one direction and otherwise permits the cover 24 to be returned and slid in a direction toward the compact, closed, storage position shown in FIG. 1 without need to actuate the unlocking mechanism.

In one contemplated embodiment as best shown in FIG. 2, the underside of the cover 24 may be provided with recessed cam tracks 50 along each side edge thereof. Separate cams 40 extend within each of the cam tracks 50. If desired, opposed pairs of cams 40 can be located in the cam tracks 50 such that the number of pairs of cams 40 correspond in number to the rows of spaced-apart hollow compartments 36. As an alternative, only a single pair of cams 40 can be provided such that once the cover 24 is unlocked relative to the cams 40, the cover 24 is free to slide the length of the base 22.

In the illustrated embodiment, the cams 40 in each cam track 50 are formed in a single file line, one behind the other, with a space or slot 42 separating each adjacent set of cams 40. The base 22 has a pair of flexible and resilient tabs 28 extending along the sides of the dispenser 20 parallel to the direction of sliding of the cover 24 relative to base 22. See FIGS. 3 and 4. Each tab 28 includes an inwardly and upwardly directed latch 28*a* that engages and slides within one of the cam tracks 50. When the tabs 28 are in a normal non-actuated condition, the latches 28*a* are "locked" behind a cam 40 to prevent movement of the latch 28*a* past the confronting cam 40 and thereby movement of the cover 24 relative to the base 22 in a dispensing direction. This condition is illustrated in FIG. 3. However, upon depression of both opposed tabs 28, the latches 28*a* are moved inward within the cam tracks 50 and inward of the single file line of cams 40 thereby freeing and disengaging the latches 28*a* from the cams 40 and permitting sliding of the cover 24 relative to the base 22. This condition is illustrated in FIG. 3A. This permits the latches 28*a* to travel over the adjacent cams 40 into the next space 42 behind the next set of cams 40. When the tabs 28 are released by the user, the tabs 28 are resilient and return the latch 28*a* to the normal position locked behind the next cam 40 in line. The spaces 42 are located such that the cover 24 advances to an extent required for the caps 38 of the cover 24 to be aligned over the next row of compartments 36.

As illustrated, each cam 40 can be tapered having a wedge shape in plan view. See FIG. 4. Thus, when the user attempts to slide the cover 24 in a dispensing direction to locate the caps 38 of the cover 24 over the next row of compartments 36, the larger end of the cam 40 prevents such movement unless the tabs 28 are simultaneously pressed inward. See FIG. 3. However, if the user attempts to slide the cover 24 in a direction toward the compact, closed storage position shown in FIG. 1, the tapered end permits the latches 28*a* to slide over the cams 40 so that the cover 24 can be returned to its original storage position.

In one embodiment, the cover 24 is of one-piece construction and can be molded of substantially rigid plastic and the base 22 is of one-piece construction and can be molded partly of substantially rigid plastic and partly of the elastomeric material forming the elastomeric seal 26. The plastic material used to make the base 22 and cover 24 can be any plastic material, recycled plastic material, or thermoplastic material such as polypropylene. In one embodiment, the cover 24 is constructed of polypropylene, which may be natural (semi-transparent) polypropylene, and the base 22 is constructed of both polypropylene and of Santoprene™ thermoplastic elastomer.

The slide dispenser 20 as described herein may be manufactured by injection molding a cover 24 from a plastic material and injection molding a base 22 from a plastic material and an elastomeric material via a dual shot injection molding operation such that a deformable elastomeric seal 26 is molded integrally on the upper face 34 of the base 22. In one embodiment, the compartments 36 may also at least partly be formed of the elastomeric material. In another embodiment, the compartments 36 are essentially formed solely of the plastic material.

Rotary Dispenser

Figure 7:
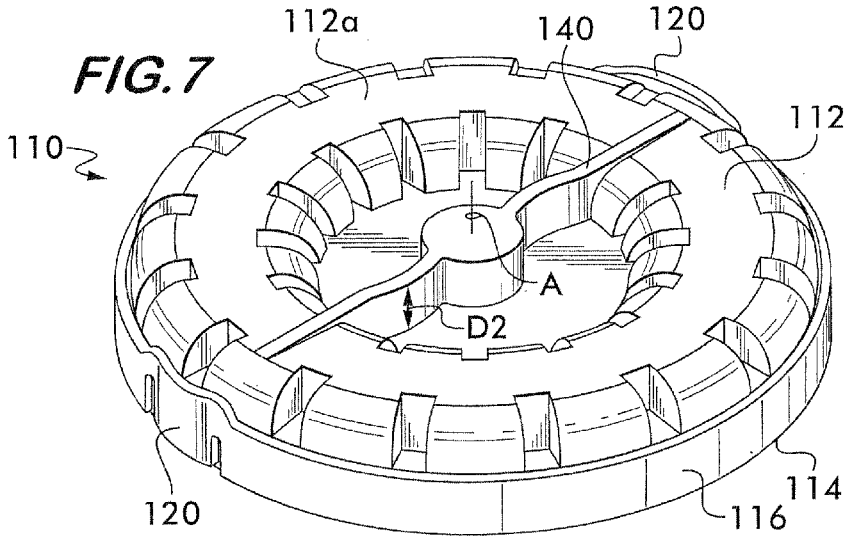
FIG. 7 is a perspective view of an assembled rotary pill dispenser according to a second contemplated embodiment.

Instead of a slide dispenser construction with a cover sliding off and onto a base as discussed above, a dispenser can be provided in the form of a rotary dispenser in which body parts slide relative to one another along an axis of rotation. For example, the body of a substantially disc-shaped rotary dispenser 110 is shown in FIG. 7. Preferably, the dispenser 110 can be produced of a size capable of being gripped by a single hand of an intended user, but not by a young child. For instance, when the disc-shaped dispenser 110 is supported on or adjacent an adult hand, the tips of the thumb and index or middle finger of the hand should be able to engage about the peripheral edge of the dispenser 110 and squeeze the dispenser 110 at diametrically opposed locations on the outer peripheral edge. The other hand of the end user should remain free to enable it to simultaneously apply a twisting force to the dispenser 110 to cause rotation of one structural part of the dispenser 110 relative to an opposite structural part of the dispenser 110. In contrast, a single hand of a young child should be too small to grip and simultaneously squeeze diametrically opposite locations on the outer peripheral edge of the disc-shaped dispenser 110.

Figures 9, 10:
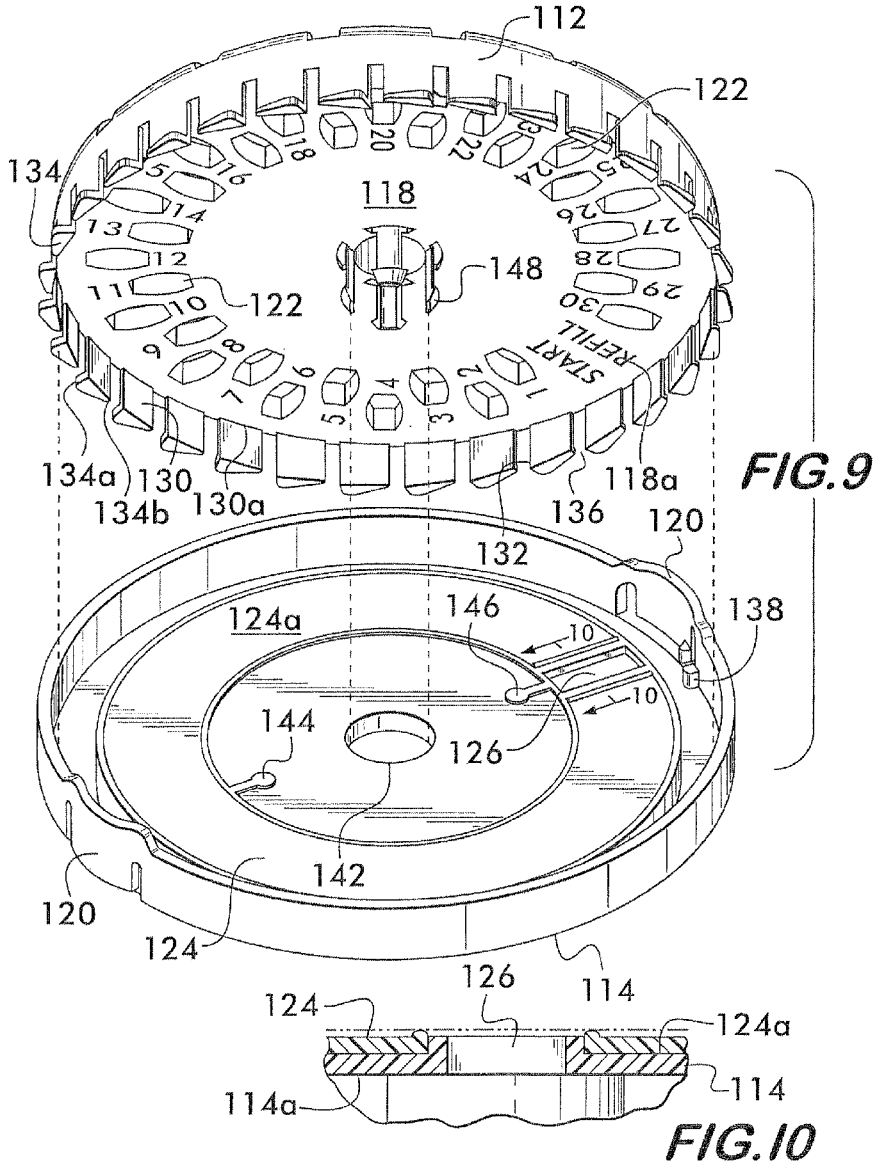
FIG. 9 is an exploded perspective view of the two-piece body of the rotary pill dispenser of FIG. 7 in a pre-assembled condition.
FIG. 10 is a cross-sectional view across the rotary pill dispenser opening along line 10-10 of FIG. 9.

The body of the substantially disc-shaped rotary dispenser 110 can be constructed and/or assembled solely from an opposed pair of separately-manufactured body parts 112 and 114 as best shown in FIG. 9. Thus, assembly of the dispenser 110 may require only a single step, i.e., securing the body part 112 to the body part 114 such as by snapping the body parts 112 and 114 together. When assembled, the body parts 112 and 114 can be caused to rotate relative to one another in certain conditions about an axis of rotation "A" extending centrally through the dispenser 110. This is explained in greater detail below.

The first body part 112 can form one exposed outer wall or face 112*a* of the dispenser 110 and the opposite second body part 114 can form an opposite outer wall or face 114*a* of the dispenser 110. As shown in the illustrated embodiments, the second body part 114 can also form a substantially circular outer peripheral edge 116 of the dispenser 110. For purposes of ease of description only, the parts 112 and 114 can be referred to as a "base" and a corresponding "cover", respectively; however, these terms are relative and interchangeable and either part can be viewed as a base or a cover or as a top or a bottom of the dispenser. For purposes of the present description of a substantially disc-shaped rotary dispenser, the body part 112 will be termed the "base" and the body part 114 will be termed the "cover" with no limitation being implied.

The first part or "base" 112 is of a sufficient depth "D2" enabling it to define at least one circular array of separate, spaced-apart, hollow compartments 122, each capable of containing a tablet or like item to be stored and ultimately dispensed. As best illustrated by the embodiment shown in FIG. 9, the base 112 can include an inner face 118 which is located and embedded within the assembly of the dispenser 110 and which is generally planar and co-planar with open ends 122*a* of the compartments 122. Thus, each hollow compartment 122 can be recessed relative to or behind the inner face 118 of the base 112 and otherwise provide a sealed compartment except for the open end 122*a*.

Indicia 118*a* can be printed, molded, engraved, embossed or otherwise provided on the inner face 118 adjacent each compartment 122 and at the beginning and/or end of the circular array of compartments 122. The indicia 118*a* is located within the assembly of the dispenser 110 and is not meant to be viewed externally of the dispenser 110 except through a relatively small dispensing opening 126 of the dispenser 110 described below in greater detail. Simply by way of example, the indicia "START" can be located at the beginning of the circular array of compartments 122, each compartment 122 can thereafter be progressively labeled with a number ascending or descending such as from 1 to 30,and the circular array can end with the indicia "REFILL". "START" as viewed through the dispensing opening 126 of the dispenser 110 may refer to an initial condition of a fully loaded dispenser 110. The numbers or indicia next to the compartments 122 as viewed through the dispensing opening 126 may provide an indication of the number of tablets dispensed or remaining to be dispensed, and the indicia "REFILL" as viewed through the dispensing opening 126 may indicate that the dispenser 110 is empty. Of course, indicia of any kind can be used in place of "START", "REFILL" and the numeric indicia are merely provided in FIGS. 8 and 9 for purposes of example and not limitation.

The second part or "cover" 114 forms an opposite half or part of the dispenser 110 relative to the base 112 and connects to the base 112 in a manner permitting cover 114 to be rotatable relative to base 112 under certain conditions. When the cover 114 is assembled and attached to the base 112 such that the indicia "START" appears through the dispensing opening 126 of the dispenser 110, the open ends 122*a* of the circular array of compartments 122 defined by the base 112 are aligned and covered by an inner wall 124 of the cover 114.

Figure 11:
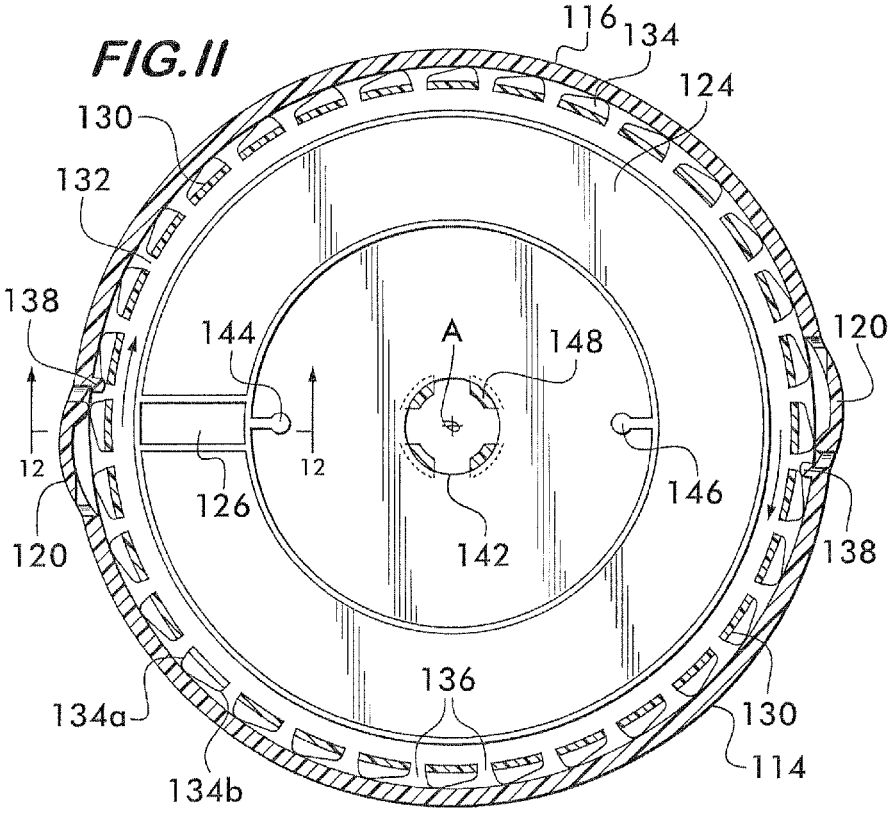
FIG. 11 is a cross-sectional view taken horizontally through the rotary dispenser of FIG. 7.

In some contemplated embodiments, the inner wall 124 of the cover 114 includes a deformable elastomeric seal 124*a* which is shown as being substantially annular in FIGS. 9 and 11. The annular elastomeric seal 124*a* is affixed on an underside of the cover 114 in a stationary position relative to the cover 114 and is rotatable with the cover 114 relative to base 112. In this condition, the seal 124*a* extends over and is pressed against the open ends 122*a* of compartments 122 to close and seal the openings. In some contemplated embodiments, when the base 112 and cover 114 are secured together, the elastomeric seal 124*a* is placed in a compressed state such that the elastomeric seal 124*a* tightly seals about each compartment 122 and is slightly pushed into each compartment 122. This compressed state of the elastomeric seal 124*a* between the cover 114 and base 112 permits it to provide a fluid- or air-tight seal for each compartment. Thus, although the compartments 122 may be rotatable relative to the elastomeric seal 124*a*,the elastomeric seal 124*a* functions as a so-called "wiper seal" and maintains a seal despite the relative movement. This type of seal prevents moisture, humidity, contaminants and the like from entering a compartment prior to its contents being dispensed. It also eliminates the need for the use of a separate blister compartment relative to the body of the dispenser 110. Thus, the assembly requires only the base 112, cover 114, and a supply of pills or the like which are loaded into the compartments 122. No additional internal packaging element is required thereby reducing manufacturing, materials, and assembly complexity and costs.

The second part or "cover" 114 has a dispensing opening 126 that extends through the deformable elastomeric seal 124*a* and cover 114 as shown in FIGS. 9-11. When the base 112 is rotated relative to the cover 114, the dispensing opening 126 can be registered or aligned with any single one of the compartments 122 of the circular array in sequential order. The dispensing opening 126 is preferably of a size enabling only one or a small defined number of compartments 122 to be exposed and in a position permitting dispensing. By way of example, the dispensing opening 126 may only enable dispensing from one compartment 122 at-a-time. Thus, one compartment 122 and its corresponding indicia 118*a* may be aligned with the dispensing opening 126 and exposed at any given time.

Figure 8:
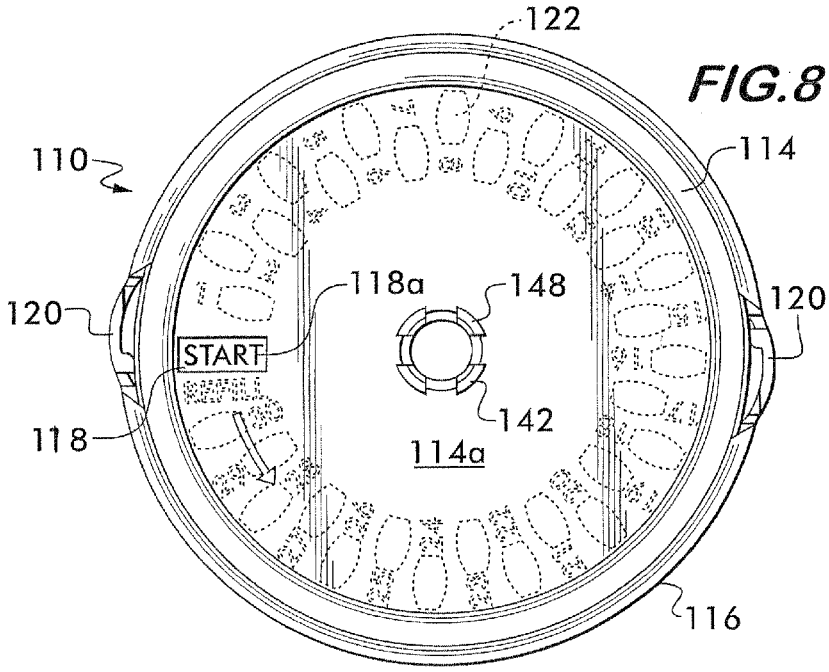
FIG. 8 is a bottom plan view of the rotary pill dispenser shown in FIG. 7 showing the word "START" displayed in a dispensing opening of the dispenser indicating that the dispenser is full, the phantom showing of a circular array of internal pill compartments, corresponding numeric indicia, and "REFILL" indicia is provided for illustrative purposes only.

As best illustrated in FIG. 8, the dispensing opening 126 may first be aligned with the indicia "START". This indicates a full dispenser 110 and that all compartments 122 are sealed by the elastomeric seal 124*a*.Thereafter, as the base 112 is rotated relative to the cover 114 (the base 112 being rotated in a counter-clockwise direction as shown disposed in FIG. 8), the compartment labeled with the indicia "1" can be aligned with the dispensing opening 126 permitting the first pill to be dispensed. Further sequential rotation permits one pill at-a-time to be dispensed from compartments 122 labeled with indicia "2" to indicia "30" until the indicia "REFILL" registers with the dispensing opening 126. This indicates that no further pills remain in the dispenser 110.

The rotary dispenser 110 is provided with child-resistant dispensing properties via a locking mechanism that under normal conditions prevents rotation of the cover 114 relative to the base 112. Thus, in the normal condition, access to pills or the remaining pills in the dispenser 110 is prevented since rotation of the base 112 relative to the cover 114 is prevented. However, the dispenser 110 also includes an unlocking mechanism that, when actuated, permits rotation of the cover 114 relative to the base 112, but only to the next compartment 122 in sequence. Thus, actuation of the unlocking mechanism may enable the user to rotate the dispensing opening 126 from alignment with the first compartment to the second compartment; however, it does not permit alignment with any compartments beyond the second compartment without having to release and re-actuate the unlocking mechanism.

In one contemplated embodiment of the dispenser 110, the cover 114 remains locked to base 112 with rotation being prevented unless a pair of diametrically opposed tabs 120 on the outer peripheral edge 116 of the disc-shaped dispenser 110 are simultaneously depressed while the base 112 is twisted in an opposite direction relative to the cover 114. For instance, one hand of the intended user may squeeze the pair of tabs 120 between the thumb and middle or index finger while the other free hand of the user simultaneously applies a twisting, turning or unscrewing force to the dispenser 110.

Here, the opposite tabs 120 are located far enough apart that would make it difficult for a single hand of a young child to grip and squeeze both tabs 120. Even if both tabs 120 become depressed by the young child, the young child would not have sufficient dexterity to also simultaneously turn or rotate the base relative to the cover so as to cause the base 112 to rotate relative to the cover 114. Thus, a high level of child-resistance is provided; yet an intended user can easily dispense the pills from the dispenser 110 when needed.

In the illustrated embodiment, the base 112 includes a circular array of separate wall sections 130 shown as tooth-like elements extending from the inner face 118 of the base 112 toward the cover 114. These wall sections 130 are located along or adjacent an outer periphery of base 112 and inside, adjacent and concentric relative to the external edge wall 116 of the dispenser 110 provided by the cover 114. For instance, see FIG. 11. Each adjacent pair of wall sections 130 is spaced-apart and defines a slot-shaped opening or gap 132 therebetween. Thus, because each wall section 130 is separated from adjacent wall sections 130, an external force can be applied to the wall section 130 to deflect, push or pivot the wall section 130 inwardly in a radial direction toward the center of the dispenser 110 (see FIG. 13) without the adjacent wall sections 130 being moved from their normal upstanding position. In addition, each wall section 130 is sufficiently flexible and resilient to return to its original and normal upstanding position after the external force is removed (see FIG. 12). Thus, a base section 130*a* of each wall section 130 forms a so-called live hinge that permits the wall section 130 to pivot inwardly as shown in FIG. 13 upon being subject to an external force and to resiliently return to its normal position as shown in FIG. 12 after the force is terminated.

As best shown in FIGS. 9 and 11, each wall section 130 may include at least one laterally-extending flange 134 that extends outward and radially toward the outer peripheral edge wall 116 of the cover 114. As best shown in FIG. 11, each flange 134 can be tapered in plan view such that a leading end 134*a* of the flange 134 extends closer to the edge wall 116 than the trailing end 134*b* of the flange 134. A small open space or locking cavity 136 is provided between the trailing end 134*b* and leading end 134*a* of each pair of adjacent flanges 134. See FIG. 11. This locking cavity 136 enables the wall sections 130 and corresponding flanges 134 to capture a latch 138 extending from the outer edge wall 116 of the cover 114. The capture of the latch 138 prevents rotation of the cover 114 relative to the base 112.

When a wall section 130 is caused to be pivoted or pushed inwardly as previously described, rotation of the cover 114 relative to the base 112 is permitted to proceed for a distance of about the width of one wall section 130 to the next locking cavity 136. Further rotation is prevented by the trailing end 134*b* of the next adjacent flange 134 of the next adjacent wall section 130. When the deflected wall section is permitted to return to its original position, rotation of the cover 114 relative to the base 112 in the opposite direction is also prevented due the leading end 134*a* of the wall section returning to its normal position.

Figure 12:
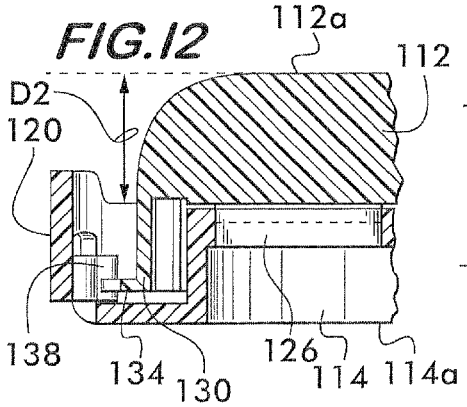
FIG. 12 is a cross-sectional view of the dispenser along line 12-12 of FIG. 11 in which the rotary pill dispenser is in a locked condition preventing rotation of the opposite body parts of the dispenser.
Figure 13:
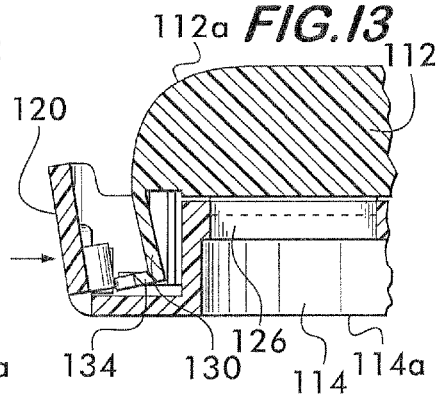
FIG. 13 is a cross-sectional view similar to FIG. 12 except that the rotary pill dispenser is in an unlocked condition permitting rotation of the opposite body parts of the dispenser.

As best reflected in FIGS. 11-13, the cover 114 provides a sidewall, or outer peripheral edge, 116 that extends adjacent and covers the circular array of upstanding wall sections 130 and locking cavities 136 of base 112. As shown in FIG. 12, the sidewall or edge 116 includes a pair of diametrically disposed tabs 120 each adjacent a latch 138 extending radially inward from the edge wall 116 of the cover 114. Each tab 120 has a deflection arm spaced closely to the latch 138 such that, when the tab 120 is pushed inward, the deflection arm presses against the adjacent wall section 130 of the base 112 to permit the latch 138 to escape from one locking cavity 136 and be permitted to advance to the next adjacent locking cavity 136 when cover 114 is caused to be rotated relative to base 112. Thus, when both tabs 120 are pressed inwardly, two diametrically opposed wall sections 130 are deflected inwardly thereby enabling rotation of the cover 114 relative to the base 112 equal to about the width of one wall section 130. When the tabs are released, the latches 138 become trapped in locking cavities 136 and rotation is prevented. This sequential rotation of the cover 114 relative to the base 112 can continue for one compartment 122 at a time until one full rotation of the cover 114 relative to the base 112 when the indicia "REFILL" appears in the dispensing opening 126.

For purposes of enabling ready twisting of the base 112 relative to the cover 114, the base 112 of the rotary dispenser 110 may have an upstanding graspable fin 140 extending from the outer face 112*a*.The fin 140 is for use in receiving a force to cause base 112 to rotate relative to cover 114 when the pair of tabs 120 of the cover 114 is simultaneously pressed inward as described above.

In one contemplated embodiment, base 112 is of one-piece construction and can be molded of substantially rigid plastic and cover 114 is of one-piece construction and can be molded partly of substantially rigid plastic and partly of an elastomeric material forming the elastomeric seal 124*a*.Anchors 144 and 146 of the elastomeric seal 124*a* may extend into the rigid plastic of cover 114 as part of the molding process. The anchors 144 and 146 ensure that seal 124*a* rotates with the cover 114 and remains stationary relative to the cover 114. The plastic material used to make the base and cover can be any plastic material, recycled plastic material, or thermoplastic material such as polypropylene. The elastomeric material can be any material with rubber-like qualities.

The rotary dispenser 110 may be assembly by connecting the base 112 to the cover 114 such as via a snap fit mechanical engagement. For instance, the base 112 may include a series of centrally-disposed, barbed, upstanding prongs 148 and cover 114 may include a centrally disposed aperture defining a collar 142 into which prongs 148 of base 112 extend and lock to cover 114 providing mechanical engagement of base 112 to cover 114 in a manner permitting rotation of base 112 relative to cover 114. A force can be created by the mechanical engagement causing the deformable elastomeric seal 124*a* to deform into the openings of compartments 122 to ensure an air or fluid tight seal of the open ends 122*a* of the compartments 122.

The rotary dispenser 110 may be constructed solely of base 112 and cover 114. Thus, the entire assembly process may require pills to be loaded into the compartment 122 and the cover 114 to be snapped to the base. Alternatively, the prongs 148 may be separately formed to fasten the cover to the base. In such an embodiment, openings for the prongs 148 would be included in the base 112 so that prongs 148 may pass through base 112 and lock to cover 114.

The rotary dispenser 110 as described herein may be manufactured by injection molding a base 112 from a plastic material such that base 112 has a circular array of hollow pill compartments 122 molded in the face thereof and injection molding a cover from a plastic material and an elastomeric material via a dual shot injection molding operation such that the deformable elastomeric seal 124*a* is molded integrally on an underside of cover 114 and a dispensing opening is formed through the cover 114 and elastomeric seal 124*a*.The pills can be loaded in the compartments of base 112, and thereafter the cover 114 can be connected to the base 112 to form a rotary dispenser 110 in which the elastomeric seal 124*a* is in a compressed state and extends over compartments 122 to tightly seal compartments 122.

During the step of injection molding base 112, the base 112 may be formed with a circular array of upstanding wall sections 130 along an outer periphery of the base 112 defining an array of locking cavities 136. During the step of injection molding the cover 114, the cover 114 may be formed with a sidewall 116 having a pair of diametrically disposed latches 138 and depressible tabs 120. During the connecting step, the latches 138 extend in a normal condition within locking cavities 136 to prevent rotation of cover 114 relative to base 112. The connecting step may consist of forming a snap-fit mechanical engagement between cover 114 and base 112.

The dispensers as described herein provide several advantages over the dispensers known in the art, which advantages are not intended to exclude other advantages which will be apparent to one of skill in the art. The dispensers rely on mechanical force alone for locking the cover to the base. The mechanical force causes compression and deformation of an elastomeric seal located between the confronting surfaces of the cover and base and creates an air-tight seal between the rigid plastic of the base and the cover. When the cover is slid or rotated relative to base, the elastomeric seal acts as a wiper seal. The seal formed eliminates the need for a separate blister package element or seal to be applied over the tablets, pills, or other solid unit dosage forms, and thus permits one-step assembly.

The dispensers provide for child resistance in a number of ways, yet remain senior friendly to use. Only the simultaneous depression of spaced apart and opposed tabs permits the cover to be slid or rotated relative to the base. This requires minimal force for a senior citizen, yet the diametric distance of tabs and the coordination required to depress tabs simultaneously renders the dispenser inoperable to a small child.

While the developments have been described with reference to specific embodiments, it will be appreciated that modifications can be made without departing from the spirit of the invention. Such modifications are intended to fall within the scope of the appended claims.

The invention claimed is:

1. A dispenser for packaging tablets, comprising:

a base having spaced-apart hollow compartments for containing tablets;

a cover connected to said base in a manner permitting said cover to slide relative to said base, said compartments of said base having openings and said cover extending over said openings of said compartments; and a deformable elastomeric seal extending between confronting surface of said base and cover and being in a compressed state therebetween for tightly sealing said compartments;

said cover having a row of flip-up dispensing caps, said compaitinents of said base being provided in a series of rows, and said cover being slidable across said base to align said caps over each of said series of rows one row at a time such that, when said row of flip-up dispensing caps is aligned with one of said series of rows of spaced-apart hollow compartments, contents of said row of spaced-apart hollow compartments may be dispensed.

2. The dispenser according to claim 1, wherein said row of flip-up dispensing caps are hinged to said cover.

3. The dispenser according to claim 1, wherein said base further comprising at least two flange segments for slideably engaging said cover against said elastomeric seal and said compartments.

4. The dispenser according to claim 1, further comprising a locking mechanism preventing sliding of said cover relative to said base and an unlocking mechanism that, when actuated, permits sliding of said cover relative to said base, whereby said locking and unlocking mechanisms provide the dispenser with child-resistance.

5. The dispenser according to claim 4, wherein said cover has an underside formed with a pair of recessed cam tracks with a series of cams formed therein corresponding to rows of spaced-apart hollow compartments provided by said base, said cam tracks extending along opposed side edges of said cover parallel to a direction of sliding of said cover relative to said base, and wherein said cam tracks and cams from part of said locking mechanism.

6. The dispenser according to claim 5, wherein said base comprises a pair of flexible and resilient tabs extending along sides of said base parallel to the direction of sliding of said cover relative to said base, wherein each tab includes a latch extending within one of said cam tracks and engagable with said cams to prevent the cover from sliding relative to said base in at least one direction, and wherein each tab can be resiliently pushed inward to cause said latch to disengage from said cams within said cam track and permit sliding of said cover relative to said base in said at least one direction.

7. The dispenser according to claim 1, wherein said base comprises at least one raised front stop preventing sliding of said cover beyond a fully closed position of the dispenser in a direction opposite an intended direction for dispensing.

8. The dispenser according to claim 1, wherein said base is of one-piece construction and is molded partly of substantially rigid plastic and partly of an elastomeric material forming said elastomeric seal, and said cover is of one-piece construction and is molded of substantially rigid plastic.

9. A child-resistant rectangular slide dispenser for packaging and dispensing pills, comprising:

a one-piece molded base connected to a separate one-piece molded plastic cover;

said base forming one side of the dispenser and having at least one row of spaced-apart hollow compartments for containing pills, and a deformable elastomeric seal located on a surface of said base between and surrounding said openings of said compartments and confronting said cover in a compressed state such as to tightly seal said compartments with said cover;

said cover forming an opposite side of the dispenser and being connected to said base in a manner permitting said cover to slide relative to said base, said compartments of said base having openings and said cover extending over said openings of said compartments, said cover comprising at one end thereof a row of flip-up dispensing caps corresponding to said at least one row of spaced-apart hollow compartments;

wherein when said row of flip-up dispensing caps is aligned with said at least one row of spaced-apart hollow compartments, contents of said at least one row of spaced-apart hollow compartments may be dispensed.

10. The dispenser according to claim 9, wherein said base further comprises at least two flange segments for slideably engaging said cover against the surface of said compartments.

11. The dispenser according to claim 9, further comprising a locking mechanism preventing sliding of said cover relative to said base in at least one direction and an unlocking mechanism that, when actuated, permits sliding of said cover relative to said base in said at least one direction, whereby said locking an unlocking mechanisms provide the dispenser with a child-resistant dispensing property.

12. The dispenser according to claim 11, wherein said cover has an underside having an opposed pair of recessed cam tracks in which a series of separate spaced-apart cams are located, and wherein said cam tracks and cams focus parts of said locking mechanism.

13. The dispenser according to claim 12, wherein said base comprises a pair of tabs located in opposed sides of said base, wherein each of said tabs includes a latch engagable with one of said cams, wherein each of said tabs can be resiliently pushed inward to cause said latch to disengage from said cams and permit sliding of said latch within said cam track beyond an adjacent cam so that said cover is permitted to slide relative to said base.

14. The dispenser according to claim 9, wherein said row of flip-up dispensing caps are hinged to said cover.

15. The dispenser according to claim 9, wherein said base comprises at least one raised front stop preventing sliding of said cover from a fully-closed, compact storage position opposite an intended direction for dispensing.

16. A method of manufacturing a child-resistant dispenser for packaging and dispensing pills, comprising the steps of:

injection molding a cover from a plastic material and separately injection molding a base having a plurality of spaced-apart hollow compartments from a plastic material, wherein one of said injection molding steps including injection molding an elastomeric material via a dual shot injection molding operation such that a deformable elastomeric seal is molded integrally on a surface of one of said cover or base for forming a confronting surface with an opposite one of said cover or base;

loading pills in the compartments of the base; and after said loading step, connecting said cover to said base to form a dispenser in which the elastomeric seal is in a compressed state and provides a tight seal of said compartments via connection of said cover to said base.

17. The method according to claim 16, wherein, during the step of injection molding the cover, the cover is formed with a pair of recessed cam tracks having cams formed therein; wherein during said step of injection molding the base, the base is formed with at least two flange segments for slideably engaging said cover against the surface of said compartments and a pair of flexible and resilient tabs in opposed side edges of the base, wherein each tab includes a latch engaging one of said cams to prevent sliding of the cover relative to the base in at least one direction, wherein each tab can be resiliently pushed inward to cause said latch to disengage from said cam thereby permitting sliding of said cover relative to said base in said at least one direction.

18. The method according to claim 16, wherein the dispenser is a rotary dispenser in which said cover is rotatable relative to said base or a slide dispenser in which said cover is linearly slidable relative to said base.

* * * * *